US005870984A

United States Patent [19]

Hasegawa et al.

[11] Patent Number: 5,870,984

[45] Date of Patent: Feb. 16, 1999

[54] VARIABLE ENGINE VALVE DRIVER

[75] Inventors: Tadao Hasegawa, Toyota; Kiyoshi Sugimoto, Okazaki, both of Japan

[73] Assignee: Toyota Jidosha Kabushiki Kaisha, Toyota, Japan

[21] Appl. No.: 954,913

[22] Filed: Oct. 21, 1997

[30] Foreign Application Priority Data

Oct. 23, 1996 [JP] Japan ..... 8-280995

[51] Int. Cl.[6] ..... F01L 1/34; F02D 13/02

[52] U.S. Cl. ..... 123/90.18; 123/90.5

[58] Field of Search ..... 123/90.15, 90.16, 123/90.17, 90.18, 90.22, 90.27, 90.28, 90.31, 90.48, 90.5

[56] References Cited

U.S. PATENT DOCUMENTS

| | | | |
|---|---|---|---|
| 4,794,893 | 1/1989 | Masuda et al. | 123/90.17 |
| 4,850,311 | 7/1989 | Sohn | 123/90.18 |
| 5,148,779 | 9/1992 | Okuse et al. | 123/90.28 |
| 5,329,895 | 7/1994 | Nishida et al. | 123/90.18 |
| 5,367,991 | 11/1994 | Asai et al. | 123/90.18 |
| 5,381,764 | 1/1995 | Fukuma et al. | 123/90.18 |

FOREIGN PATENT DOCUMENTS

| | | |
|---|---|---|
| 0116306 | 8/1984 | European Pat. Off. . |
| 3-179116 | 8/1991 | Japan . |

*Primary Examiner*—Weilun Lo
*Attorney, Agent, or Firm*—Kenyon & Kenyon

[57] ABSTRACT

A valve drive device has a pair of valves in association with a cylinder and a pair of cams provided on the camshaft to selectively open and close the valves. Each cam has a cam surface and a cam nose. The cam surface has an axially varying radius at the cam nose. A bearing supports the camshaft between the pair of cams. A pair of valve lifters are arranged respectively between the cams and the valves. Each valve lifter has a supporting surface and a cam follower supported on the supporting surface to slidably contact with the cam surface. A moving mechanism moves axially to change the lift amount of the valves, Each cam follower is located farther from the bearing, which is positioned between the pair of cams, than the center of the supporting surface in the axial direction of the camshaft. This results in greater axial movement of the cams and a greater variation of valve lift without placing excessive axial lodes on the camshaft.

6 Claims, 6 Drawing Sheets

VARIABLE ENGINE VALVE DRIVER

BACKGROUND OF THE INVENTION

The present invention relates to a valve drive device of an engine, and more specifically to a valve drive device in which a cam profile for driving a valve are changed according to the operating conditions of the engine.

As a valve drive device of an engine for automobiles of a DOHC type, various proposals have heretofore been made in which the opening and closing timing or a lift amount of a intake valve or an exhaust valve is changed according to the operating conditions of the engine. In such a valve drive device, the opening and closing timing or the lift amount of the valve is changed according to the operating conditions of the engine whereby the engine characteristics of torque or the like are controlled so as to suit to the current operating conditions.

According to one such valve drive device, a low speed cam and a high speed cam having cam profiles different from each other are provided on a single camshaft. The cam for driving the valve is switched according to the operating conditions of the engine. In this drive device, since there are two independent cams (low speed and high speed), the cam nose radiuses of the cams can differ greatly. Accordingly, the maximum lift amount of the valve can be made sufficiently small for the low speed range of the engine, and sufficiently large for the high speed range. It is therefore easy to obtain the desired engine characteristics for the current speed range.

On the other hand, for example Japanese patent Laid-open No. Hei 3-179116 Publication discloses a valve drive device in which one kind of a cam 40, the cam nose radius of which varies in the axial direction of a camshaft 42, is provided on a single camshaft 42, as shown in FIG. 7. Each cam 40 on the camshaft 42 is moved in the axial direction together with the camshaft 42 by a shaft moving mechanism 41. Each valve 43 is pressed against a cam surface 40*a* of the cam 40 through a cam follower 45. Two valves 43 neither intake or exhaust valves) are arranged with respect to one cylinder of the engine. Accordingly, the cams 40 are moved in the axial direction together with the camshaft 42 whereby the region of the cam surface 40*a* in contact with the cam follower 45 changes. As a result, the maximum lift amount of each valve 43 changes. The range of change of the maximum lift amount (hereinafter, referred to as the lift control amount) is determined according to the difference between the maximum value and the minimum value of the radius of the cam nose.

Accordingly, the lift control amount may be increased by increasing the width W in the axial direction of the cams 40 and increasing the difference between the maximum value and the minimum value of the radius of the cam noses. However, the camshaft 42 is supported by a journal bearing 44, which is between tho two cams 40. For this reason, the moving amount D in the axial direction of the cams 40 is restricted by the interference of the cams 40 and the bearing 44. Accordingly, the width W and the moving amount D of the cam 40 is restricted.

A large lift control amount may be obtained without increasing the width W and the moving amount D of the cam 40 by increasing the inclination angle θ of the cam surface 40*a* at the cam nose. By doing so, the difference between the maximum value and the minimum value of the radius of the cam nose becomes large.

Alternatively, the width S of a sliding contact surface 45*a* of the cam follower 45, which is in sliding contact with the cam surface 40*a*, may be made small. By doing so, the effective range in the axial direction of the cam surface 40*a* along which the cam follower 45 can be moved becomes relatively large. As a result, the difference between the maximum value and the minimum value of the radius of the cam nose can be effectively utilized. This achieves a large lift control amount without increasing the width W of the cam 40.

However, when the inclination angle e of the cam surface 40*a* at the cam nose is made large, the axial component of the load on the shaft 42 applied to the camshaft 42 from each valve 43 increases. Accordingly, the driving force of the shaft moving mechanism 41 must be increased, and the moving mechanism 41 becomes large accordingly. Moreover, the increase of the load in the axial direction of the shaft 42 is not preferable for the stabilized driving of the valve 43.

Further, when the width S of the sliding surface 45*a* of the cam follower 45 is made small, the pressure receiving area of the sliding surface 45*a* becomes small. Therefore, the surface pressure applied to the sliding surface 45*a* increases. As a result, the cam follower 45 tends to wear. Further, it is necessary to increase the moving amount D of the cam 40 in order to take advantage of the difference between the maximum value and the minimum value of the radius of the cam nose. However, since the moving amount D of the cam 40 is restricted, the lift amount is limited.

SUMMARY OF THE INVENTION

An object of the present invention is to provide a valve drive device for an engine that achieves a larger lift control amount without steeply inclining the inclination angle of the cam nose and without making the sliding area of the cam follower very small.

For achieving the aforementioned object, a valve drive device of an engine according to the present invention including a valve for opening and closing a combustion chamber. The valve is actuated with a variable valve lift amount. The valve drive device comprises a bearing provided in the engine, a camshaft rotatably supported by the bearing, and a cam provided on the camshaft for integrally rotating with the camshaft to selectively open and close the valve. The cam has a cam surface for driving the valve and a cam nose. The radius of the cam surface varies axially at the cam nose. A valve lifter is arranged between the cam and the valve to transmit the motion of the cam to the valve. The valve lifter has a supporting surface and a cam follower supported on the supporting surface to slidably contact the cam surface. moving means moves the cam axially to change the lift amount of the valve. The axial movement of the cam changes the position of the cam surface with respect to the cam follower to change the lift amount of the valve, The cam follower is offset from the center of the supporting surface in a direction away from the bearing.

Other aspects and advantage at the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

Figure 5:
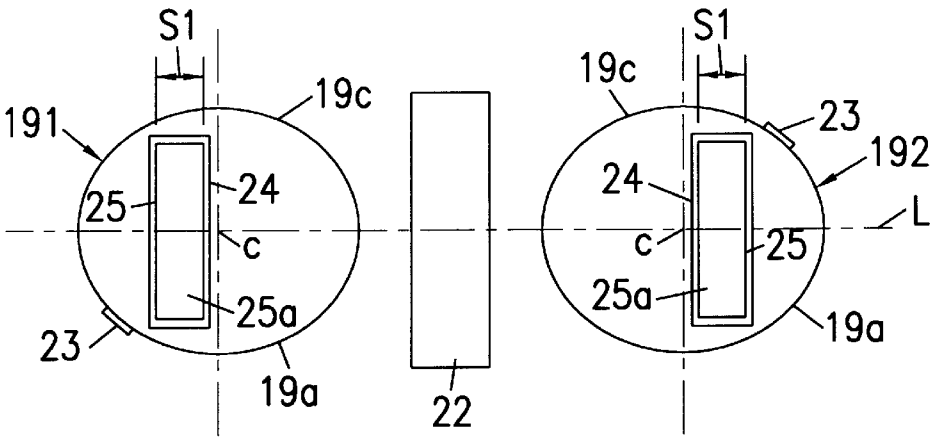
Figure 6:
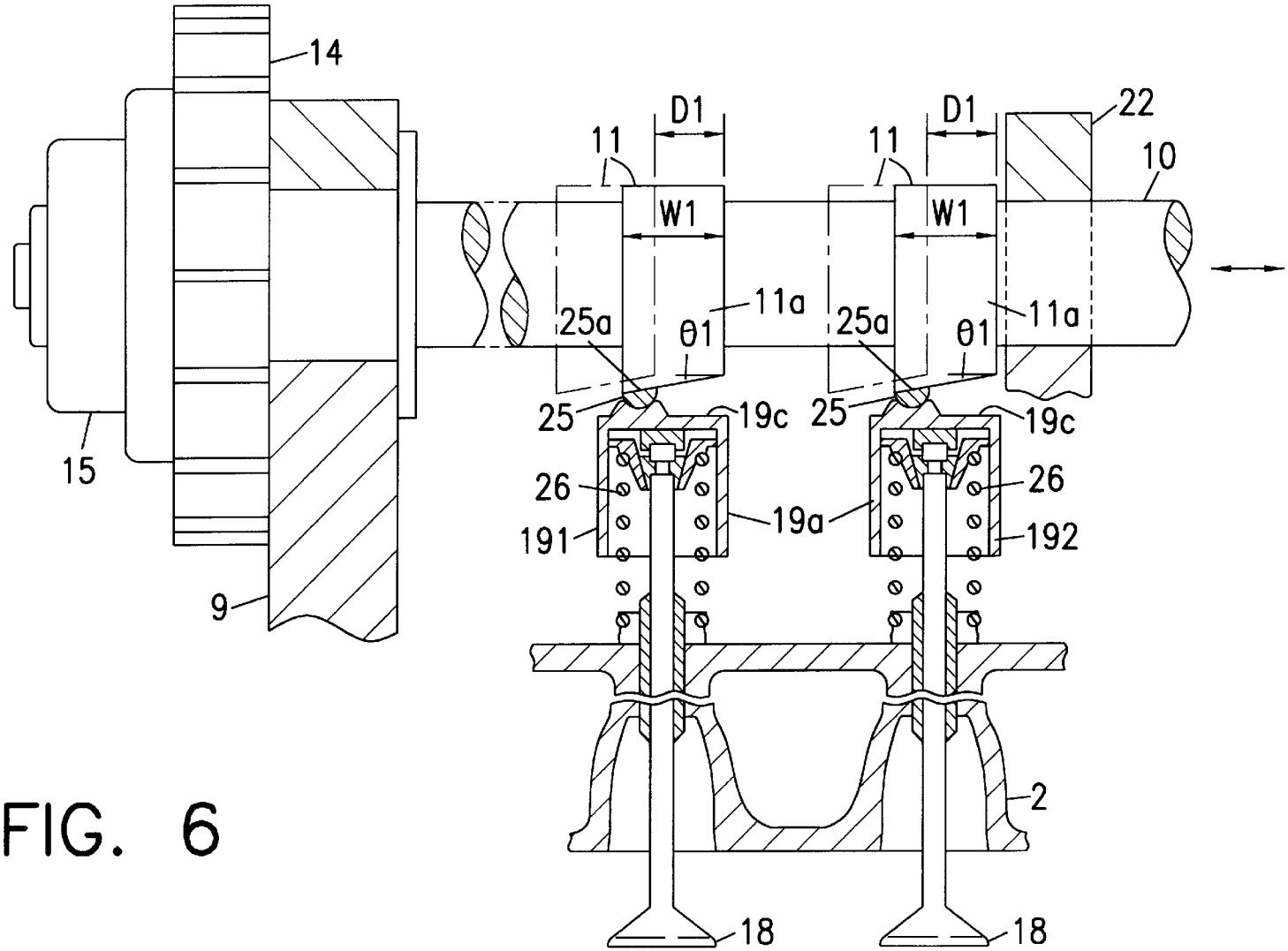
Figure 7:
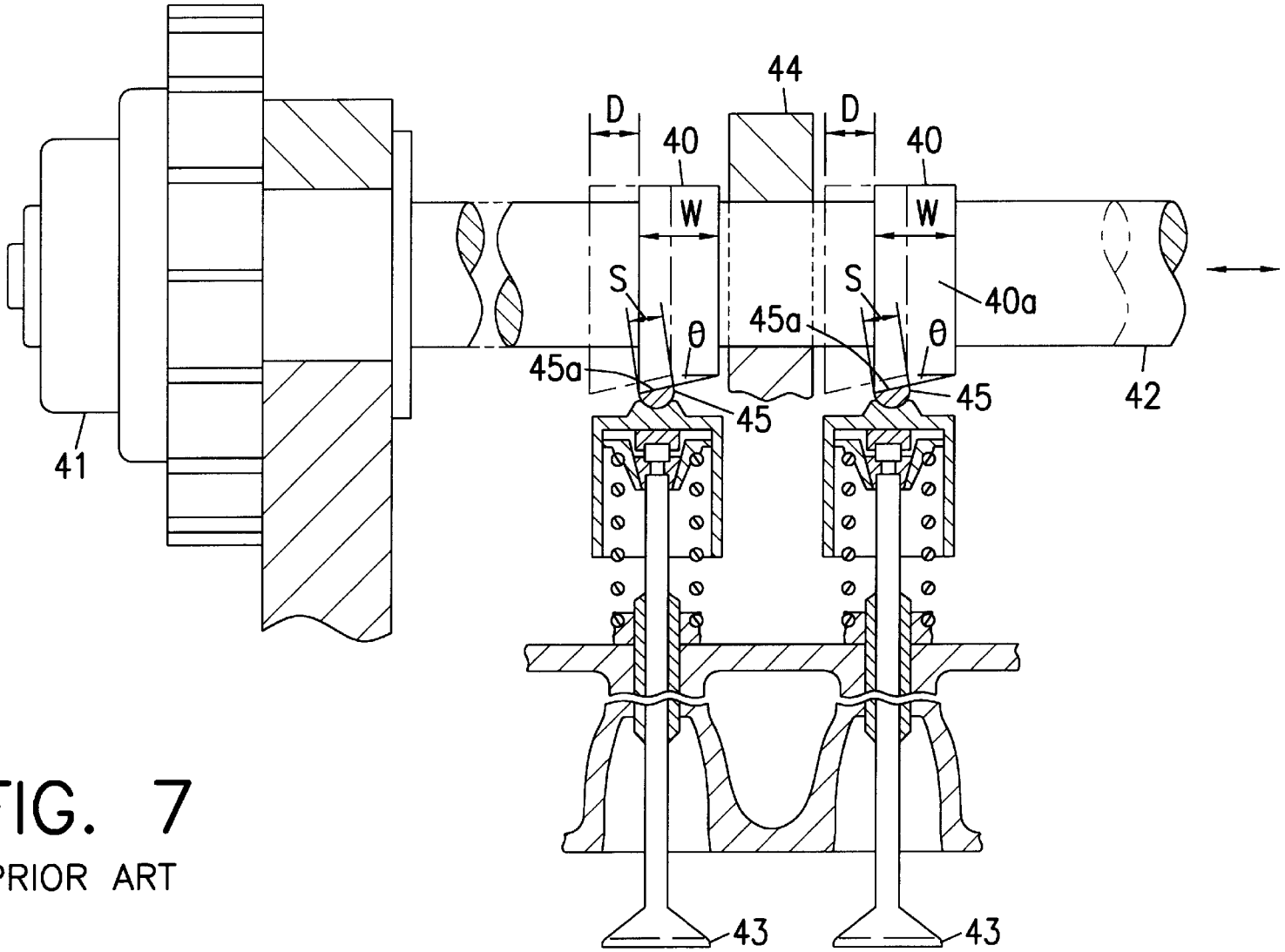
FIG. 7 PRIOR ART

FIG, 4 is an enlarged perspective view of a valve lifter;

FIG. 5 is a plan view of a pair of valve lifters;

FIG. 6 is a partial sectional view showing a valve drive device according to a second embodiment; and FIG. 7 is a partial sectional view showing a conventional valve drive device.

DETAILED DESCRIPTION OF THE PREFERRED EMBODIMENTS

The first embodiment will be explained hereinafter with reference to FIGS. 1 to 5.

Figure 2:
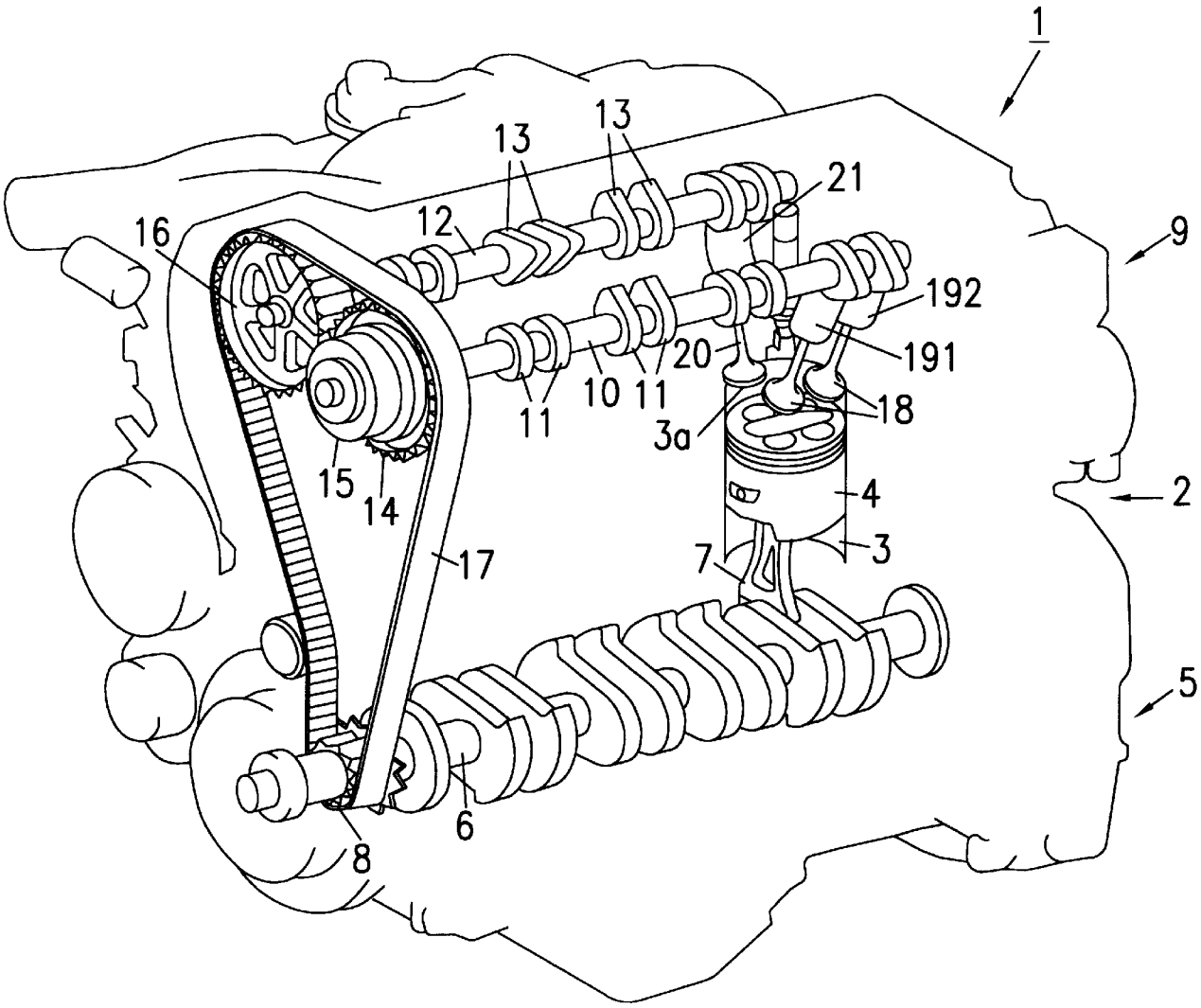
FIG. 2 is a partial perspective view showing an engine provided with the valve drive device.

FIG. 2 shows a valve drive device of an engine for automobiles, This engine 1 is of a DOHC type, in which four valves (two intake valves and two exhaust valves) are arranged corresponding to one cylinder.

A plurality of cylinders 3 are provided in a cylinder block 2 of the engine 1, and a piston 4 is arranged in each cylinder 3. A crank case 5 supporting a crankshaft 6 is secured to a lower portion of the cylinder block 2. Each piston 4 is connected to the crankshaft 6 by a connecting rod 7. A timing pulley 8 is fixed to one end of the crankshaft 6.

Figure 1:
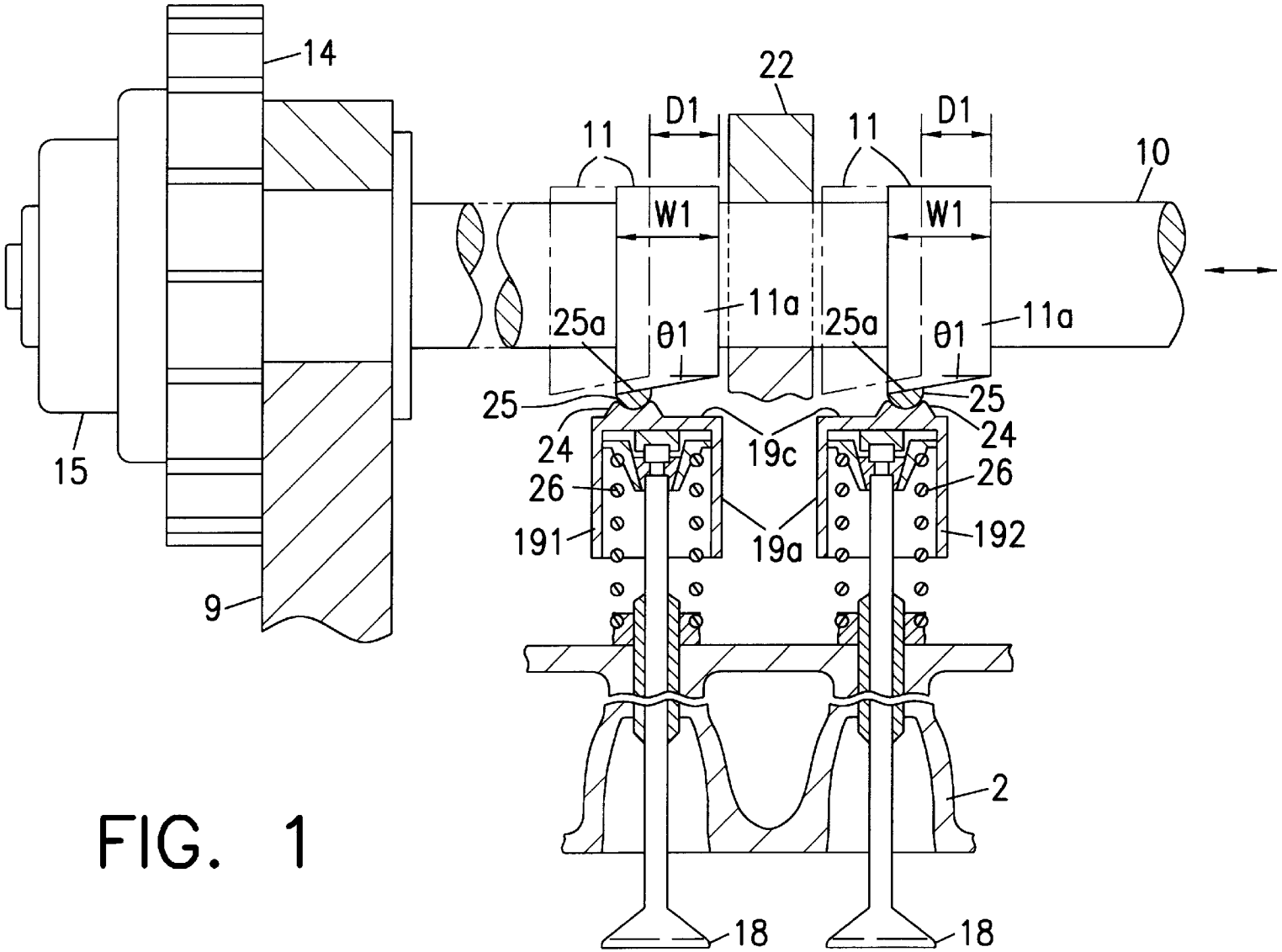
FIG. 1 is a partial sectional view showing a valve drive device according to a first embodiment of the present invention.

An intake camshaft 10 is supported on a cylinder head 9 secured to an upper portion of the cylinder block 2 so that the camshaft 10 is rotatable and axially movable by a plurality of journal bearings 22 (see FIG. 1). A plurality of intake cams 11 are Integrally provided on the intake camshaft 10. A pair of intake came 11 correspond to a single cylinder 3. Further, an exhaust camshaft 12 is likewise rotatably supported on the cylinder head 9 by a plurality of journal bearings (not shown). On the exhaust camshaft 12, a pair of exhaust cams 13 correspond to each cylinder 3.

A timing pulley 14 and a shaft moving mechanism 15 are integrally provided on one end of the intake camshaft 10. A timing pulley 16 is fixed on one end of the exhaust camshaft 12. Both the timing pulleys 14 and 16 are connected to a timing pulley 8 of the crankshaft 6 by a timing belt 17. When the crankshaft 6 rotates, the intake camshaft 10 and the exhaust camshaft 12 are driven.

A pair of intake valves 18 correspond to each cylinder 3. The intake valves 18 are connected to and driven by the intake cams 11 through valve lifters 191 and 192. The valve lifters 191 and 192 are slidably supported within litter bores (not shown) provided in the cylinder head 9.

Further, each cylinder 3 is provided with a pair of exhaust valves 20, Each exhaust valve 20 is driven by the exhaust cam 13 through a valve lifter 21. The valve lifter 21 is slidably supported within the lifter bore not shown.

A combustion chamber 3*a* is formed within each cylinder 3 by the piston 4. An intake passage and an exhaust passage (neither is shown) are connected to each combustion chamber 3*a*. Each pair of intake valves 18 are provided within the intake passage to control the air flow from the intake passage to the associated combustion chamber 3*a*. Each pair of exhaust valves 20 are provided within the exhaust passage to control the exhaust gas flow from the associated combustion chamber 3*a* to the exhaust passage. As the camshafts 10 and 12 rotate, the cams 11 and 13 selectively open and close the corresponding valves 18 and 20 through the valve lifters 191, 192 and 21.

Figure 3:
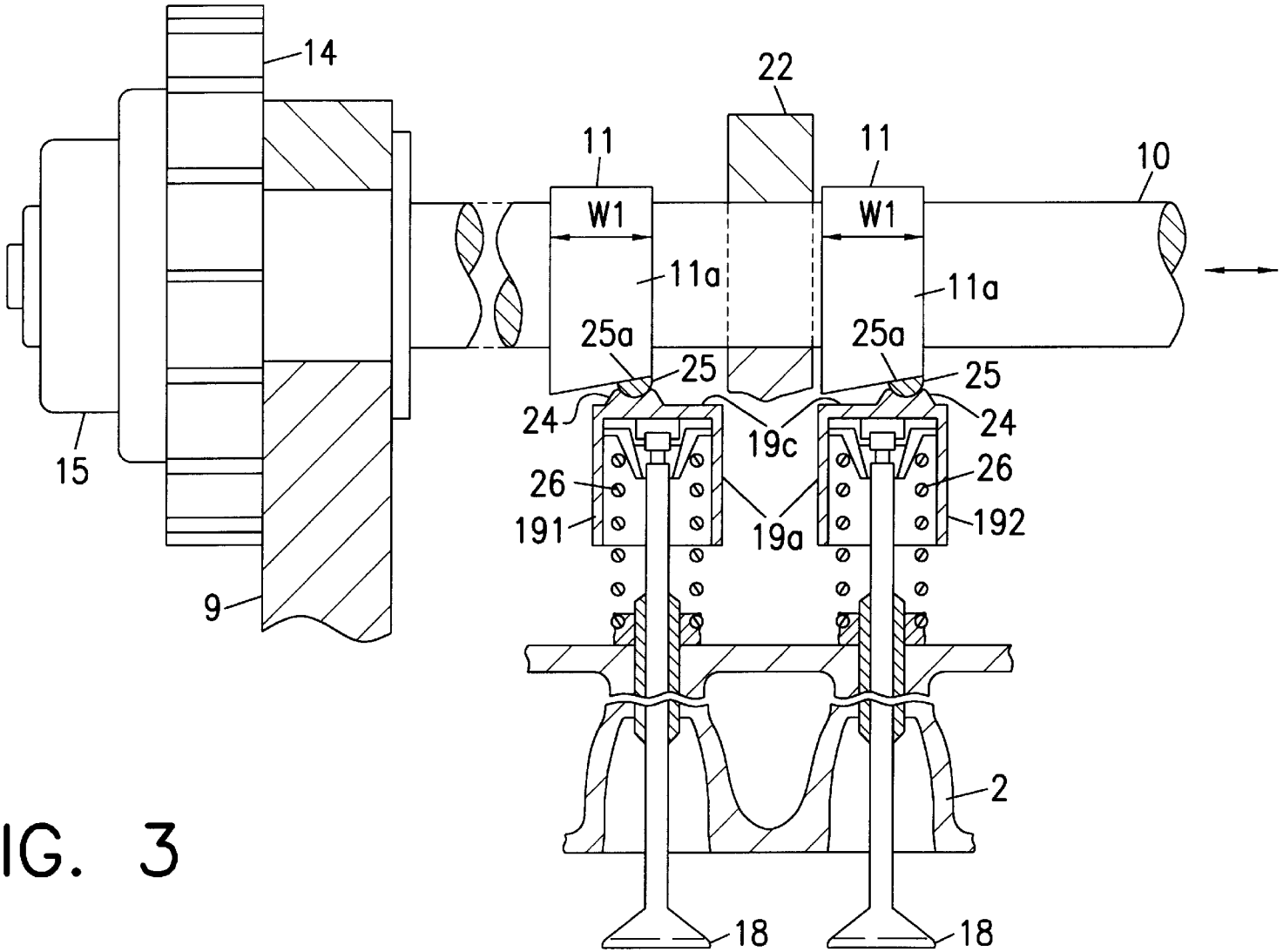
FIG. 3 is a sectional view like FIG. 1 showing a state in which the camshaft is moved axially from the state shown in FIG. 1.

FIGS. 1 and 3 show the shaft moving mechanism 15 connected to the intake camshaft 10 and the intake valves 18 for one cylinder driven by the camshaft 10. A journal bearing 22 is located on the cylinder head 9 between the pair of intake cams 11 that are associated with the cylinder 3. The journal bearing 22 supports the intake camshaft 10 rotatably, and it permits the camshaft 10 to move in the axial direction.

The intake cam 11 supported on the intake camshaft 10 is a known solid cam, and the radius of the cam surface 11*a* at the cam nose varies continuously in the axial direction. An inclination angle θ1 of the cam surface 11*a* at the cam nose is the same as the inclination angle θ of the cam nose of the cam 40 in the prior art shown in FIG. 7.

Figure 4:
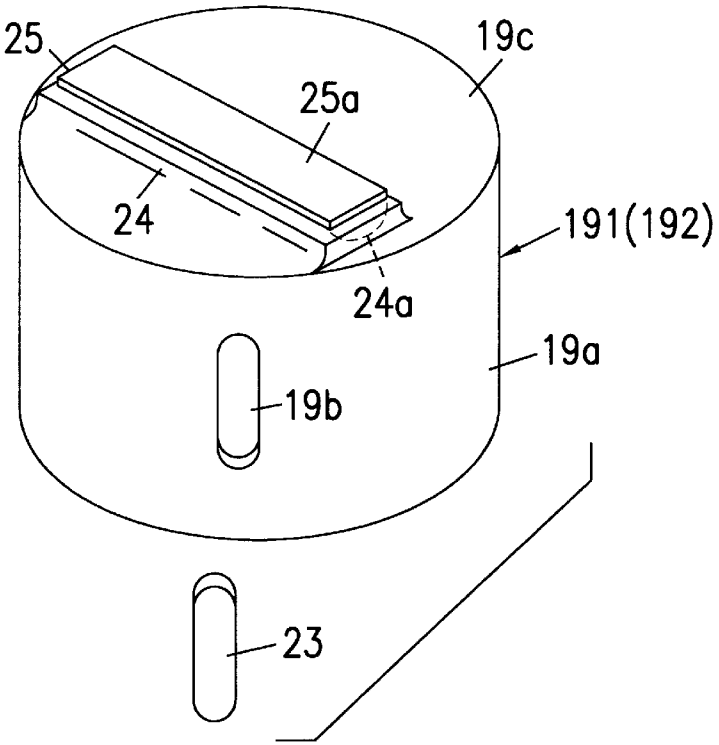

The valve lifters 191 and 192 have the same shape, however, they are oriented differently from one another by 180 degrees of rotation, as shown in FIGS. 1 and 5. As shown in FIG. 4, the valve lifters 191 and 192 have a cylindrical shape, the upper end of which is closed, as shown in FIG. 4, and a guide member 23 is provided on the outer peripheral surface 19*a* thereof, The guide member 23 is secured to a fitting recess 19*b* formed in the outer peripheral surface 19*a* by pressing or welding. The guide member 23 is engaged with an engaging portion (not shown), such as a groove formed in the inner peripheral surface of the lifter bore, so that the valve lifters 191 and 192 can not rotate, but are slidably movable in the axial direction of the lifter bores.

The valve lifters 191 and 192 each have cam follower holders 24 integrally formed in their upper surfaces 19*c*. The holder 24 has a long groove-like holding recess 24*a*, the cross section of which is arcuate. Within each holding recess 24*a*, a cam follower 25 is pivotally supported in the holding recess 24*a*. The cam follower 25 has an arcuate surface in sliding contact with the holding recess 24*a* and a planar sliding contact surface 25*a* for making sliding contact with the cam surface 11*a* of the intake cam 11. Each holder 24 is laterally offset from the center C of the upper surface 19*c* in a direction that is perpendicular to the pivot axis of the cam follower 25, as shown in FIG. 5. In other words, each cam follower 25 is offset from the center C of the upper surface 19*c* in the direction of the camshaft axis L.

As shown in FIG. 5, each valve lifter 191 and 192 is supported within a lifter bore so that each cam follower 25 extends in a direction orthogonal to the axis L of the camshaft 10. Each cam follower 25 is laterally offset away from the center C of the upper surface 19*c* and away from the bearing 22. The width S1 of the sliding surface 25*a* of the cam follower 25 is the same as the width S of the sliding surface 45*a* of the cam follower 45 in the prior art shown in FIG. 7. The sliding surface 25*a* of each cam follower 25 in the valve lifters 191 and 192 is pressed against the cam surface 11*a* of the corresponding intake cam 11 by means of a spring 26, as shown in FIG. 1. As each intake cam 11 rotates, the corresponding cam follower 25 oscillates along the cam surface 11*a*, and the corresponding intake valve 18 is driven.

As described above, each cam follower 25 is offset from the center C of the upper surface 19*c* of the lifters 191 and 192 so that each cam follower 25 is located as far as possible from the journal bearing 22. As shown in FIG. 1, the width W1 of the intake cam 11 is greater by the offset distance than the width W of the cam 40 in the prior art shown in FIG. 7. The axial movement amount D1 of the cam 11 is also greater than the corresponding amount D of the cam 40 in the prior art so as to match the larger width W1 of the cam 11. In other words, in the intake cam 11 of the present embodiment, the inclination angle θ1 of the cam nose is the same as the inclination angle θ of the cam nose in the conventional cam 40, while the difference between the maximum value and the minimum value of the radius of the cam nose is larger than that of the conventional cam 40.

The shaft moving mechanism 15 is a well-known mechanism driven by a hydraulic circuit (not shown) according to the operating conditions of the engine 1 (including at least the number of revolutions per minute of the engine 1) to move the intake camshaft 10 together with the intake cam 11 in the axial direction. The shaft moving mechanism 15 moves the intake camshaft 10 so that the contact position between the cam surface 11*a* of the intake cam 11 and the sliding contact surface 25*a* of the cam follower 25 varies between the highest radius position (see FIG. 1) of the cam nose and the lowest radius position (see FIG. 3) of the cam nose. As a result, the maximum lift amount of the intake valve 18 is small in the low speed region of the engine 1 and high in the high speed region.

In the present embodiment, each cam follower 25 is offset from the center C of the upper surface 19*c* of the lifters 191 and 192 to be as far as possible from the journal bearing 22. Therefore, the width W1 and the axial movement amount D1 of the intake cam 11 are greater than those of the cam 40 in the prior art while avoiding interference between the intake cam 11 and the bearing 22. This increases the difference between the maximum value and the minimum value of the radius of the cam nose without changing the inclination angle θ1 of the cam nose in the intake cam 11 from that in the prior art.

Accordingly, it is possible to increase the range of change in the maximum lift amount of the intake valve 18 without increasing the inclination angle θ1 of the cam nose. Further, since the inclination angle θ1 of the cam nose is the same as that of the prior art, the load in the axial direction of the camshaft 10 applied by the intake valve 18 to the camshaft 10 remains the same. Accordingly, it is not necessary to make the shaft moving mechanism 15 larger in size, and the operation of the intake valve 18 is stable.

Further, since the width S1 of the sliding contact surface 25*a* of the cam follower 25 is the same as the width S of the cam follower 45 in the prior art, the surface pressure applied to the sliding contact surface 25*a* is not increased. Because of this, the durability of the cam follower 25 is not lowered.

The present invention is not limited to the above-described embodiment, but can be constructed in many other ways including the following.

While in the engine 1 shown in FIG. 1, the journal bearing 22 is located between the pair of intake cams 11 corresponding to the cylinder 3, the present invention may be used in an engine in which the journal bearing 22 is provided between a pair of adjacent cylinders 3, as shown in FIG. 6. In this case, the cam followers 25 on both the valve lifters 191 and 192 corresponding to a single cylinder 3 are offset in the same direction to be positioned as far as possible from the adjacent journal bearing 22.

The present invention may also be employed in a valve drive device that moves only the intake cam 11 without moving the intake camshaft 10. In such a device, the advantages of the first embodiment can also be achieved.

The present invention may be employed not only by the valve drive device on the intake side, but by the valve drive device on the exhaust side or by both the valve drive devices.

The present invention may be used not only in an engine having four valves per cylinder, but by an engine having, for example, three or five valves per cylinder.

Therefore, the present examples and embodiments are to be considered as illustrative and not restrictive and the invention is not to be limited to the details given herein, but may be modified within the scope and equivalence of the appended claims.

What is claimed is:

1. A valve drive device of an engine, the engine including a pair of valves arranged in association with a combustion chamber, said pair of valves for opening and closing the combustion chamber, and each of the valves is actuated with a variable valve lift amount said valve drive device comprising:

a bearing provided in the engine;

a camshaft rotatable supported by the bearing;

a pair of cams arranged in association with the pair of valves, each of the cams being provided on the camshaft for integrally rotating with the camshaft to selectively open and close one of the valves, each of the cams having a cam surface for driving said one of the valves, and each of the cams having a cam nose, wherein a radius of the cam surface varies axially at the cam nose, and the bearing supports the camshaft between the cams;

a pair of valve lifters arranged between the pair of cams and the pair of valves, respectively, each of the valve lifters arranged between one of the cams and one of the valves to transmit a motion of said one of the cams to said one of the valves, each of the valve lifters having a supporting surface, each of the valve lifters having a cam follower supported on the supporting surface to slidably contact the cam surface of said one of the cams, each of the cam followers being offset from a center of a corresponding supporting surface in a direction away from the bearing, and each cam follower being disposed farther, in an axial direction of the camshaft, from the bearing, than the center of the corresponding supporting surface; and moving means for moving each of the cams axially to change a lift amount of each of the valves, wherein an axial movement of each of the cams changes a position of the cam surface of said each cam with respect to the cam follower of said each cam to change the lift amount of the valve associated with said each cam.

2. The valve drive device according to claim 1, wherein each of the cams is fixed to the camshaft, and wherein the moving means moves each of the cams together with the camshaft.

3. The valve drive device according to claim 1, wherein each of the cam followers is held on the supporting surface of the valve lifter associated with said each cam follower such that each cam follower pivots with respect to the valve lifter associated with said each cam follower as the cam associated with said each cam follower rotates.

4. A valve drive device of an engine including a plurality of combustion chambers and a plurality of valves for opening and closing the combustion chambers, wherein the plurality of valves form valve pairs in association with each of the combustion chambers, wherein each valve is actuated with a variable valve lift amount, the valve drive device comprising:

a camshaft;

plurality of cams provided on the camshaft for integrally rotating with the camshaft to selectively open and close the valves, wherein the plurality of cams form cam pairs in association with the valve pairs, wherein each cam has a cam surface for driving the corresponding valve and a cam nose, wherein the radius of the cam surface varies axially at the cam nose;

a plurality of bearings provided in the engine to rotatably support the camshaft, wherein each bearing is located between the cams forming a corresponding pair;

a plurality of valve lifters, each arranged between a corresponding one of the cams and a corresponding one of the valves to transmit the motion of the corresponding cam to the corresponding valve, wherein each valve lifter has a supporting surface and a cam follower supported on the supporting surface to slidably contact the cam surface of the corresponding cam;

moving means for moving the cams axially to change the lift amount of the valves, wherein the axial movement of the cams changes the position of each cam surface with respect to the corresponding cam follower to change the lift amount of the corresponding valve; and wherein each cam follower is located farther, in the axial direction of the camshaft, from the bearing that is positioned between the cams forming the corresponding pair than the center of the corresponding supporting surface.

5. The valve drive device according to claim 4, wherein the cams are fixed to the camshaft, and wherein the moving means moves the cams together with the camshaft.

6. The valve drive device according to claim 5, wherein each cam follower is held an the supporting surface of the valve lifter such that the cam follower pivots with respect to the valve lifter as the corresponding cam rotates.

* * * * *

UNITED STATES PATENT AND TRADEMARK OFFICE

CERTIFICATE OF CORRECTION

PATENT NO. : 5,870,984

DATED : 16 February 1999

INVENTOR(S) : Tadao HASEGAWA et al.

It is certified that error appears in the above-indentified patent and that said Letters Patent is hereby corrected as shown below:

| Column | Line | |
|---|---|---|
| 3 | 31 | Change "Integrally" to --integrally--. |
| 3 | 32 | Change "came" to --cams--. |
| 6 | 12 | Change "rotatable" to --rotatably--. |
| 8 | 11 | Change "an" to --on--. |

Signed and Sealed this

Twenty-sixth Day of October, 1999

*Attest:*

Q. TODD DICKINSON

*Attesting Officer*

*Acting Commissioner of Patents and Trademarks*